United States Patent [19]

Tsao

[11] Patent Number: 4,722,528

[45] Date of Patent: Feb. 2, 1988

[54] GOLF PUTTER

[76] Inventor: Thomas K. Tsao, 441 Discovery Rd., Virginia Beach, Va. 23451

[21] Appl. No.: 709,679

[22] Filed: Mar. 8, 1985

Related U.S. Application Data

[63] Continuation-in-part of Ser. No. 495,502, May 17, 1983, Pat. No. 4,519,612.

[51] Int. Cl.[4] ..... A63B 53/02; A63B 53/06; A63B 69/36

[52] U.S. Cl. ..... 273/164; 273/80 C; 273/172; 273/80.2

[58] Field of Search ..... 273/167 F, 169, 171, 273/172, 173, 174, 183 D, 183 E, 186 R, 164; D21/217, 218, 219, 80 C, 167 G, 80.2

[56] References Cited

U.S. PATENT DOCUMENTS

| | | | |
|---|---|---|---|
| 1,139,985 | 5/1915 | Legh | 273/169 |
| 1,549,993 | 8/1925 | Klin | 273/172 X |
| 1,680,881 | 8/1928 | Heeter et al. | 273/169 |
| 2,929,631 | 3/1960 | Gillon | 273/183 E |
| 3,043,596 | 7/1962 | Ehmke | 273/163 R |
| 3,486,755 | 12/1969 | Hodge | 273/164 |
| 3,548,504 | 12/1970 | Sykes | 273/183 E |
| 3,880,430 | 4/1975 | McCabe | 273/183 D |
| 3,909,004 | 9/1975 | Vella | 273/167 F X |
| 4,032,156 | 6/1977 | Clarke | 273/164 |
| 4,073,492 | 2/1978 | Taylor | 273/80.2 |
| 4,136,877 | 1/1979 | Antonious | 273/164 |
| 4,147,357 | 4/1979 | Strop | 273/164 |
| 4,209,172 | 6/1980 | Yamamoto | 273/183 D |
| 4,340,229 | 7/1982 | Stuff, Jr. | 273/164 |
| 4,458,900 | 7/1984 | Antonious | 273/183 D X |
| 4,519,612 | 5/1985 | Tsao | 273/171 X |

OTHER PUBLICATIONS

"The Search for the Perfect Swing", Cochran and Stubbs, 1968, Library of Congress Catalog #68-9441, p. 41.

*Primary Examiner*—George J. Marlo
*Attorney, Agent, or Firm*—Holman & Stern

[57] ABSTRACT

The club head of a golf putter has a substantially flat bottom surface to facilitate alignment of the putt and is symmetrically weight-balanced that it's heel-to-toe center to reduce torque effects and lower its center of gravity. The weight balancing is achieved with a dense sole plate having an elongated intermediate section joining two mass-concentrated heel and toe ends. A less dense body portion provides a soft putting face and has hollowed portions to further lower the center of gravity and concentrate the club head weight at the heel and toe. The front corners of the bottom surface are cut away to reduce scuffing during a golfing stroke. A sighting device on the club head facilitates alignment of a golfer's line of sight in a vertical plane which includes the golf ball, the club head "sweet spot" and the putting target when the golfer's eye is positioned above and rearwardly of the club during alignment of the putt. The sighting device includes a rectangular recess in the upper surface of the putter and strategically located sighting lines on the upper surface and in the recess. The heel-to-toe center of the club includes the center of gravity and the "sweet spot" and is coraxially aligned with the club shaft. The lower end of the club shaft is bent rearward of the club head to an attachment point on the rear surface of the club head, centrally between the heel and toe portions.

31 Claims, 6 Drawing Figures

GOLF PUTTER

CROSS-REFERENCE TO RELATED APPLICATIONS

This application is a continuation-in-part application of my co-pending U.S. patent application, Ser. No.: 06/495,502, filed May 17, 1983 and entitled "Putter with Improved Sighting and Reduced Drag", now U.S. Pat. No. 4,519,612, issued May 28, 1985. The entire disclosure of that application is expressly incorporated herein by this reference.

BACKGROUND OF THE INVENTION

1. Technical Field

The present invention relates to improvements in golf putters and, more particularly, to such improvements which facilitate proper alignment of the club head prior to the putting stroke and which enhance putting stroke accuracy.

2. Discusslon of the Prior Art

The prior art contains a multitude of golf putter designs, each in some way intended to facilitate proper alignment between the club putting face, the ball and the cup or hole, and/or to optimize the putting stroke itself. I have found, however, that all prior art golf putters of which I am aware consider only some aspects of club alignment or stroking while ignoring others, or consider only alignment or stroking while ignoring the other. To illustrate this I shall first make reference to golf putter alignment. There are many prior golf putters provided with sighting devices intended to enable a golfer to properly position the putter relative to the ball and the cup. Examples of such patents are U.S. Pat. Nos. 2,929,631 (Gillon); 3,043,596 (Ehmke); 3,548,504 (Sykes); 3,880,430 (McCabe); 4,032,156 (Clarke); 4,136,877 (Antonious); and 4,209,172 (Yamamoto).

Some of these patents disclose sighting devices of types which are not sanctioned by the rules of the United States Golf Association (USGA). Nevertheless, each of the sighting devices aids in locating the golfer's head in a vertical plane which includes the ball, the cup and the golfers eye. In other words, these sighting devices aid the golfer in positioning his or her head so that it is not positioned transversely (i.e., to one side or the other) of the line of sight between the ball and the hole. However, these sighting devices also attempt to position the golfer's eye directly above the part of the club which is to contact the ball. For example, in one prior patent the disclosed sighting device includes a surface recessed from the top of the club head and marked with two intersecting perpendicular lines, one line extending in the desired direction of the putting stroke and in alignment with the "sweet spot" (i.e., optimal striking location) on the club face, the other line extending parallel to the club face. A second set of complementary lines are defined in a different plane at the top surface of the club head and are viewed by the golfer as lineal extensions of the recessed lines only when the golfer's head is positioned vertically above the sight, or substantially directly above the impact location between the ball and the club during the putting stroke. This positioning of the golfer's head, however, does not provide for an optimum putting stroke. By way of explanation, the motion of the club head during a proper putting stroke may be described as follows: first, the club head is moved in a rearward and upward arc during the short backswing; second, during the initial part of the forward swing, the club head reverses direction substantially along the same arcuate path, finally, after impacting against the ball, the club moves through the follow through portion of the swing in an upward and forward direction from the former ball location along a continuation of the arcuate path. When the golfer's head is directly over the impact point of the ball and club, as intended with the prior art sighting devices, a number of disadvantages result. First, the club head impacts against the ball at the nadis of the arcuate path transversed during the forward swing. This provides a "flush" contact between the club and the ball at impact, applying no topspin to the ball, with the result that the ball tends to initially "take off" in an uncontrolled manner, sometimes being raised off the putting green for the first few inches of its path. A ball thusly struck tends to move off course more readily than does a ball with topspin, and the putt is much more difficult to control. Second, when the golfer's head is positioned directly above the ball-club head impact, the golfer cannot see the rear side of the ball where the club is going to strike the ball. Accuracy demands that the point of impact on the ball be visible to the golfer.

A recognized problem with prior art golf putters relates to the tendencies of the club head to twist or turn upon impact with the ball, particularly when the impact point is displaced from the "sweet spot". For example, the golf putter club head disclosed in U.S. Pat. No. 4,147,357 (Strop) attempts to enlarge the heel-to-toe length of the "sweet spot" to minimize twisting of the head upon impact. Further, Strop configures the bottom surface of the club head arcuately to minimize the area of the head which contacts the ground during the putting stroke, thereby reducing uneven drag or stubbing of the head on the ground during the backswing and forward swing. Other putter designs which address this type of problem may be found in U.S. Pat. Nos. 4,340,229 (Stuff, Jr.), 4,073,492 (Taylor) and 3,486,755 (Hodge). However these and all prior arc putter of which I am aware appear to be designed without any recognition of the crucial relationship between initial orientation of club head (i.e., prior to positioning of the golfer's head), the heel-to-toe balance of the club head, location of the center of gravity of the club head, and the configuration of the leading edge of the bottom surface of the club head. More particularly, although the putter disclosed in the Strop patent may have an enlarged "sweet spot" and a raised bottom surface at the heel and toe, the initial positioning of the club head relative to the ground is imprecise because the bottom surface of the club head is arcuate. In other words, the club head can rock on its bottom surface and assume different orientations relative to the ground. If the heel or toe is raised during the putting stroke, the resulting tilt usually produces a pulled or pushed putt that strays from the desired course. Moreover, the head of the Strop putter is made entirely of a bronze which is heavy for providing a solid "feel" but is soft to prevent the ball from "springing" or caroming off the face plate. However, in practice this is a compromise between "feel" and "spring" wherein the "spring" effect is not sufficiently eliminated.

OBJECTS AND SUMMARY OF THE INVENTION

It is therefor an object of the present invention to provide an improved golf putter having a sighting system which permits the golfer to properly align his or her head in the vertical plane of the ball and cup, but rearwardly of the club-ball interface at impact.

Another object of the present invention is to provide a golf putter having a putting alignment and sighting device which is permissible under the rules of the USGA and which permits the golfer to naturally apply topspin to the ball during the putting stroke.

It is another object of the present invention to provide an improved golf putter which substantially eliminates twisting torque effects on the club head due to three distinct causes, namely: striking the ball at a location off the club "sweet spot", tilting of the club head relative to the ground, and stubbing the bottom surface of the club.

A further object of the present invention is to provide an improved golf putter configuration which can easily and repeatedly be aligned both with respect to the ground and to the ball, which has a low center of gravity with a low and elongated "sweet spot", which has a solid and hefty "feel" without causing uncontrolled "spring" upon impact with the ball, and which is precisely balanced to eliminate twisting of the club head.

In accordance with the present invention, a golf putter is provided with a club head including a body portion made of a relatively light, low density material joined to a sole plate fabricated from a relatively heavy, high density material. The lighter body portion encompasses the entire front or putting face and the entire top surface of the club head, as well as most of the heel, toe and rear surfaces. The sole plate encompasses all but the forward most part of the bottom surface and portions of the heel, toe and rear surfaces. The club head is symmetrical about an imaginary vertical plane which bisects the heel-to-toe dimension so that the club head is precisely balanced about its geometric center. The sole plate is provided with greater mass at its heel and toe portions than at its elongated center portions in order to lower the club head center of gravity and increase the resistance to twist-producing torque. The bottom portion of the putter is flat except for cutaway portions of the heel and toe at the forward edge of the club head. This cutaway portion, as described in my aformentioned patent application Ser. No. 495,502, eliminates stubbing or scuffing of the heel or toe at the forward edge during a putting stroke and thereby prevents twisting of the club head due to such scuffing. Importantly, however, the large planar portion of the bottom surface permits the club head to lie flat on the putting green as the golfer addresses the ball, thereby assuring that there will be no undesirable heel-to-toe tilt of the club head. The less dense and softer body material provided along the entire putting face eliminates the springing or caroming effect caused by harder and more dense material (such as those used for the sole plate) upon impact with the golf ball. In the preferred embodiment portions of the body material, disposed rearwardly of the putting face, are symmetrically removed to provide hollow portions of the club head which lower the center of gravity and amplify the torque-reducing effect of the peripheral (i.e., heel and toe) weighting of the sole plate while maintaining precise heel-to-toe balance about the geometrically centered center of gravity.

A sighting device includes a recessed region of the top surface of the club head in which two perpendicular recessed sighting lines intersect at a point equidistant from the heel and toe ends. One recessed line extends perpendicular to the putting face and resides in an imaginary vertical putting plane which includes the desired point of impact ("sweet spot") with the ball on the putting face. The second recessed sighting line extends parallel to the putting face. A third upper sighting line is defined in an unrecessed part of the top surface and extends in a vertical plane on opposite sides of the recessed so as to appear as a continuation of the first recess sighting line when viewed in that vertical plane. At least one additional upper sighting line is provided in the top surface and extends from opposite sides of the recess perpendicular to the third upper sighting line. However, the additional sighting line does not reside in the same vertical plane as the second recessed sighting line; rather, the additional sighting line is disposed rearwardly of the second recessed sighting line so that the plane defined by these lines is tilted slightly rearwardly from true vertical. A golfer, in order to align the second recessed sighting line with the additional sighting line in his or her line of sight, must, therefore, position his or her head rearwardly of the club when addressing the ball and aligning the putt. A further such additional line may be provided to account for the difference between the left eye dominant and right eye dominant golfers.

The club shaft is axially aligned with the geometric center (in the heel-to-toe dimension) of the club plane and preferably with the intersection of the recessed sighting lines. The angle of the shaft relative to vertical is set for the golfer's preference. The attachment of the club head to the shaft is at the rear surface of the club head by means of a shaft connector secured between the lower end of the shaft and the club head.

The putter of the present invention permits the golfer to properly align the ball in a vertical plane which includes the golfer's eye, the ball and the cup. Since the golfer's head is behind the club head, the club head naturally strikes the ball when the club head is on the upward part of the arcuate path and thereby naturally imparts topspin to the ball. Further, the golfer's head, when positioned behind the club, permits the golfer to view the hole by merely shifting his or her eyes in that direction without moving his or her head. In other words, in order to properly align his or her head with the sighting device, the golfer's head must be slightly turned toward the forward direction, thereby facilitating vision of the cup without movement of the golfer's head.

BRIEF DESCRIPTION OF THE DRAWINGS

These and other objects, features and many of the attendant advantages of the invention will be better understood upon a reading of the following detailed description when considered in connection with the accompanying drawings wherein like-part several figures are identified by the same reference numbers, and wherein.

DESCRIPTION OF THE PREFERRED EMBODIMENTS

Figure 1:
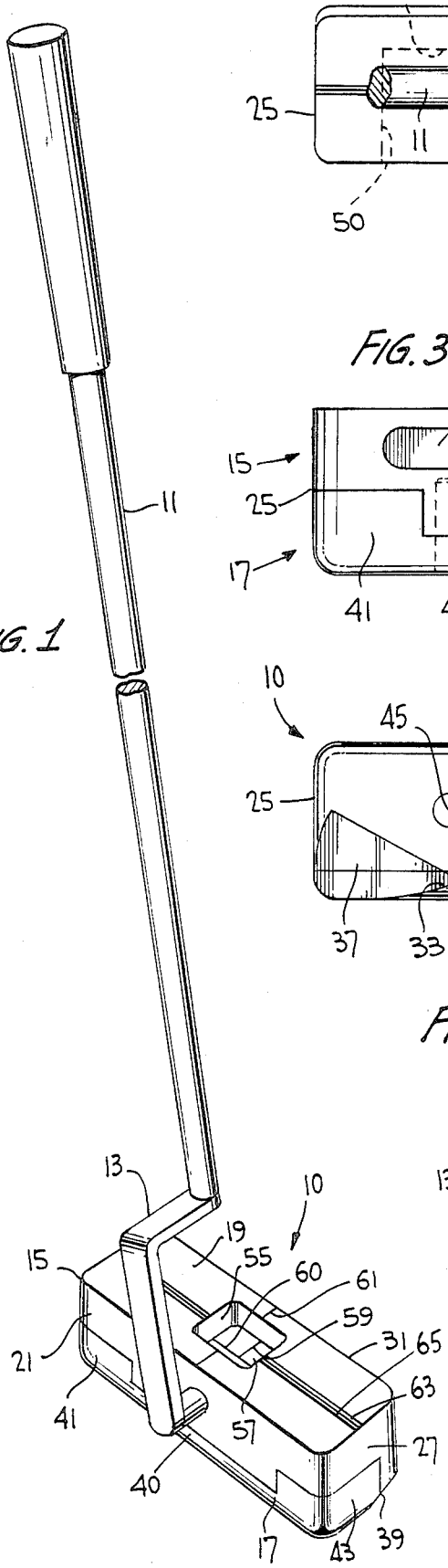
FIG. 1 is a view in perspective of a golf club constructed in accordance with the present invention.
Figure 2:
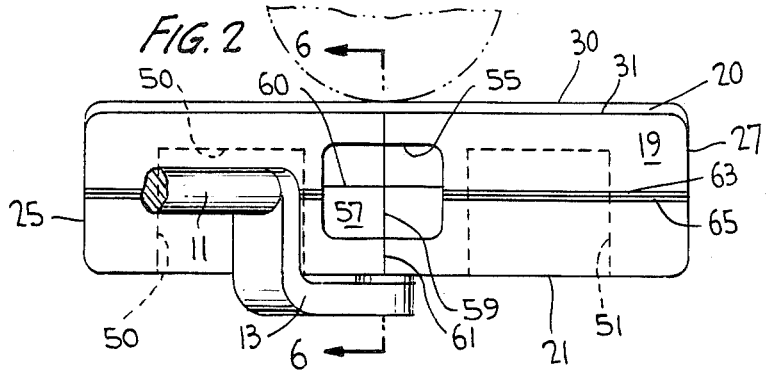
FIG. 2 is a top view in plan of the club head and a portion of the club shaft and connector of FIG. 1.
Figure 3:
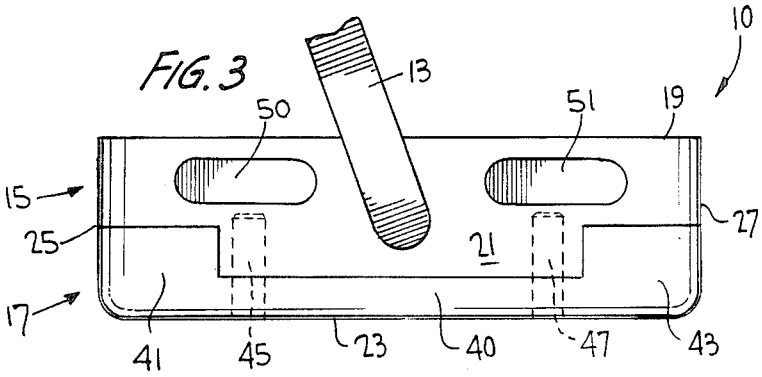
FIG. 3 is a rear view in elevation of the club head and a portion of the club shaft connector of FIG. 1.
Figure 4:
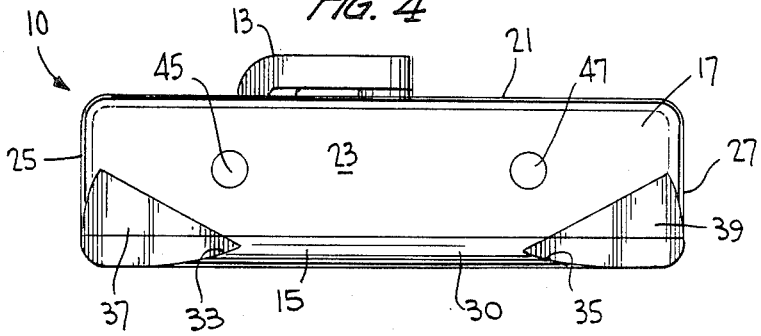
FIG. 4 is a bottom view in plan of the club head and a portion of the club shaft connector of FIG. 1.
Figure 5:
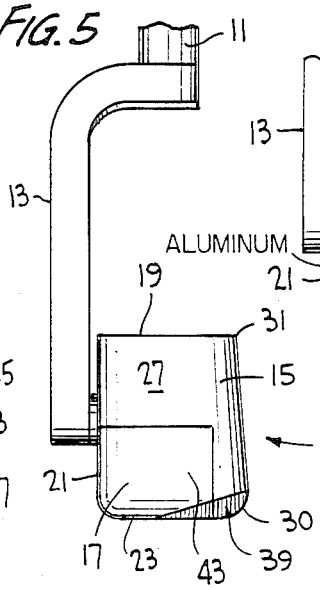
FIG. 5 is an end view in elevation of a portion of the club head and the club shaft and club shaft connector of FIG. 1.
Figure 6:
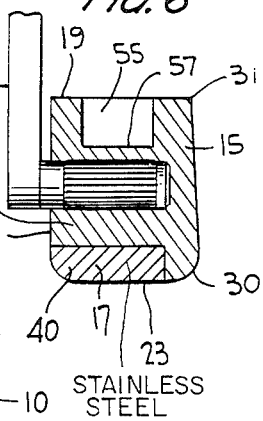
FIG. 6 is a view in section along line 6—6 of FIG. 2.

Referring to the accompanying drawings in greater detail, a golf putter according to the present invention includes a club head 10, a shaft 11 and a connecting member 13 which fixedly secures the shaft member to the club head. The club head 10 is formed by a body member 15 and a sole plate 17. The entire top surface 19 and the putting face or front surface 20 of the club head are formed from body member 15, as are parts of the rear surface 21, bottom surface 23, heel end 25 and toe end 27. Body member 15 is made of a relatively light weight soft material (e.g., aluminum, preferably anodized). The sole plate 17 encompasses most of the bottom surface 23 and a lesser part of each of the rear surface 21, heel end 25 and toe end 27. Sole plate 17 is made of a relatively heavy material (e.g., stainless steel). The specific gravity of stainless steel (7.87) is almost three times the specific gravity of aluminum (2.70) and this ratio of specific gravities is ideal for the body member and sole plate materials, in any case, however, the specific gravity ratio should be at least 2 to 1.

The overall peripheral configuration of the club head is substantially that of a rectantular parallelepiped modified in that the depth dimension (i.e., between front surface 20 and rear surface 21) of the top surface 19 is slightly shorter than the depth dimension of bottom surface 23. This leaves the putting face or front surface 20 sloped slightly rearwardly from its bottom edge 30 to the top or the upper edge 31. Typically, this slope is at an angle of approximately five degrees from vertical.

Another variation of the club head periphery from that of a strict rectangular parallelepiped exists at opposite lengthwise ends of edge 30 which correspond to the intersection of bottom surface 23 and putting face 20. Specifically, edge 30 includes a straight intermediate segment flanked by end segments 33 and 35 extending from respective opposite ends of the intermediate segment to the heel-end 25 and toe-end 27, respectively, of the club head. End segments 33 and 35 mutually diverge lengthwise of the putting face 20 in a direction toward upper edge 31. Bottom surface 23 is substantially flat and planar except for two planar cut away or recessed portions 37 and 39 of generally triangular configuration. Cut away portion 37 is bounded on one side by end segement 33, on another side by heel end 25, and on its third side by its intersection with the flat or base portion of bottom surface 23. Cut away portion 39 is bounded on one side by end segment 35, on another side by toe end 27, and on its third side by its intersection with the flat base portion of the bottom surface 23. Cut away portions 37 and 39 serve to minimize the possibility that that the club head will be twisted during a putting stroke by virtue of being scuffed or stubbed by uneven portions of the putting green. The raised or cut away portions 37, 39 of the leading bottom edge 30 clear such uneven portions during the putting stroke and thereby preclude application of a twist-producing torque to the heel or toe due to scuffing along the green. Importantly, however, although these leading portions 37, 39 of bottom surface 23 are removed, the remainder of the bottom surface is flat so that the club head can be properly placed flush on the ground, without heel-to-toe tilt, when the golfer intially addresses the ball. In a preferred embodiment, the sizes of the cut away portions 37, 39 are such that more than eighty five percent of the bottom surface is flat and planar. For purposes of the present invention, at least fifty percent of the bottom surface should be flat, although it is preferred that at least seventy five percent be flat.

The club head is constructed to be symmetrical about an imaginary vertical plane which bisects the length (i.e., heel-to-toe) dimension of the club head. This assures perfect heel-to-toe weight balance of the club head about its longitudinal center and places the center of gravity at that longitudinal center. Under these conditions the so called "sweet spot" or optimal ball-striking location is longitudinally centered between the heel and toe on putting face 20.

The function of the relatively heavy sole plate 17 is three fold: First, it lowers the center of gravity of the club head to thereby lower the height of the "sweet spot" on putting face 20; second, it provides a heavier and more solid "feel" or heft without requiring a hard or caroming surface for putting face 20; and third, it distributes the weight of the club head outwardly toward the heel and toe to increase the resistance to externally applied torque during the putting stroke. In this regard, the sole plate 17 includes a lengthwise - extending intermediate portion 40 interconnecting the end or heel or toe portions 41 and 43, respectively. The height dimension of heel and toe portions 41, 43 is substantially greater than the height of intermediate portion 40, preferably on the order of two to one. The length of the intermediate portion 40 is greater than the length of each of heel and toe portions 41 and 43, preferably on the order of three to one or more. By having the heavy sole plate 17 at the bottom of the club head, the center of gravity is lowered from the position it would assume if the entire club were made of the lighter material of body member 15. In addition, the greater specific gravity of the sole plate material increases the heft or "feel" of the club. Further, the enlarged heel and toe portions 41, 43 distribute a significant part of the club head weight at the heel and toe ends. Importantly, the increased mass portions 41, 43 at the ends of the sole plate are disposed symmetrically about the longitudinal center of the club head so that the weight balance and symmetry about the center is maintained for the entire club head structure. Sole plate 17 is secured to body member 15 by means of knurled pins 45, 47 over which adhesive material is coated and which are inserted into suitably provided aligned mounting holes defined in the body member and sole plate.

Body member 15 may be, and preferably are, provided with hollowed portions 50, 51, disposed symmetrically with respect to the longitudinal center of the club head. These hollowed portions further reduce the mass of the body member relative to the sole plate and thereby serve to further lower the center of gravity while magnifying the torque-reducing effect produced by the sole plate portions 41, 43 disposed at the heel and toe ends of the club head.

The sighting arrangement provided for the club head includes a recess 55 defined in the club head top surface 19. Recess 55 encompasses within its periphery the longitudinal center of the club head and has an upward facing recessed surface 57 at its bottom. The transverse cross section of the recess 55 is preferably rectangular, although this configuration is not a necessity within the concept of the present invention. Recessed surface 57 is preferably parallel to top surface 19. Two recessed sighting lines 59, 60 are defined on or in recessed surface 57. Sighting line 59 extends depthwise of the club head in the imaginary vertical plane which bisects the club head lengthwise; in other words, sighting line 59 extends along the longitudinal center of the club head. Sighting line 60 extends lengthwise of the club head and is perpendicular to and intersects sighting line 59. Both lines 59 and 60 extend entirely across recess 55 in their respective directions.

An upper sighting line 61 is defined in top surface 19 and extends from opposite ends of recess 55 in the aforesaid imaginary vertical plane which bisects the club head lengthwise and which contains recessed line 59. When the golfer's head is positioned with his or her line of sight in that plane, lines 59 and 61 are in alignment and appear as a continuous line across the top of the club head. The further upper sighting line 63 is defined in or on top surface 19 and extends from opposite ends of recess 55 perpendicular to line 61. The location of sighting line 63, depthwise of the club head, is slightly rearward of recessed line 60. In other words, the two parallel lines 60 and 63 define a plane which is slightly tilted or skewed with respect to vertical so that these lines can only be aligned in a golfer's line of sight when the golfer's eye is behind the club head as it strikes the golf ball. A further sighting line 65 is provided slightly rearward of and parallel to sighting line 63 in or on top surface 19. The purpose of providing two lines 63 and 65 is to account for different visual planes required by persons with left eye dominance and persons with right eye dominance. For either type of person, the head position can be the same as long as a different one of lines 63 and 65 is used for alignment with recessed line 60.

In order to provide a general idea as to the relative positions of the sighting lines required to achieve the desired result of positioning a golfer's head behind the club head at impact, the following exemplary dimensions are provided and were employed in a working embodiment of my putter. The height of the club head 10 (from bottom surface 23 to top surface 19) was 1.20 inches. The depth of recess 55 was 0.312 inches. Upper sighting line 63 was disposed 0.060 inches rearwardly of recessed sighting line 60 and 0.010 inches forwardly of upper sighting line 65. All sighting lines 59, 60, 61, 63 and 65 were engraved into their respective surfaces at a depth of 0.010 inches and a width of 0.030 inches. These dimensions are sufficient to accomoplish the desired positioning of the golfer's head for the average golfer whose crouch during putting typically places his or her eyes about three to four feet above the ground. Of course, different dimensions may be employed to accommodate other putting styles and postions.

In the aforesaid working embodiment, other relevant deminsions (to be considered as exemplarly only) were as follows: Length of club head (heel-to-toe)—4.0 inches; length of each end portion 41, 43 of sole plate 17—0.75 inches; height of portions 41, 43—0.500 inches, height of intermediate portion of 40 of sole plate 17—0.240 inches; depthwise location of intersection of recessed sighting lines 59 and 60—0.0500 inches from edge 31; depth of club head along bottom surface 23 (from rear surface 21 to edge 30)—1.20 inches.

Shaft member 11 is secured to the club head, by means of connecting member 13, such that the shaft is axially aligned with the longitudinal center of the club head. Preferably, the shaft is axially aligned with the intersection of recessed sighting lines 59 and 60. In order to accommodate this feature without visually obstructing the sighting line, the connecting member extends rearwardly from the bottom end of shaft 11, bends at a right angle downward, and then bends again at another right angle to be press fit into a suitably provided mounting hole in the rear surface 21 of the club head. Importantly, the mounting hole and the mounting location for the connecting member is longitudinally centered on the club to assure that the weight balance is not destroyed and that no twist-producing torque is caused by a force exerted off center by the shaft and connecting member. The shaft and connecting member are secured at a factory set angle from vertical, which angle may vary from club to club to accommodate different golfer's styles.

The putter of the present invention, as described hereinabove, is unique in several respects. The use of a high density sole plate, configured as described, serves at least two purposes. First, it lowers the center of gravity of the entire club head in order to lower the "sweet spot" on the putter face. This increases the margin for error by the golfer and also increases the "feel" of the putter. Second, the shape of the sole plate moves the mass of the putter toward the periphery (i.e., heel and toe) thereby increasing the resistance of the putter to torque. This, combined with the center attachment of the shaft 11 via connector 13, creates a totally torque-free putter, both for backstroke and forward stroke use. In addition to the torque free pendulum stroke permitted by the putter configuration, the "sweet spot" is disposed in the geometric center of the putter, whereas in most other putters the "sweet spot" is disposed closer to the heel.

The torque free characteristic of my putter is very important because in most putters there is a tendancy in the initial moment of force, either in the backstroke or forward stroke, for the heel to move first. My torque-free configuration eliminates this characteristic as well as the tendancy to pull or push a putt, a tendancy that is inherent in most other putters.

The lightweight and softer material used for the club head body member serves to give the putter a soft controlled "feel" when contacting the ball. This is particularly desirable when putting the new high-tech golf balls which tend to putt "hot" with conventional brass or steel head putters.

My sighting device is unique because of my recognition that it is undesirable for the golfer's eyes to be directly over the ball or the impact spot between the club and ball. Rather, the golfer's line of sight should be slightly behind the ball. When the golfer's head is positioned behind the ball, it is easier for the golfer to check his or her line to the hole and see the back of the ball at the point to be struck by the club head. In addition, my sighting device accounts for left eye dominance and right eye dominance differences among golfers.

Further, my putter is the only known putter which permits a golfer to establish a flat lie of the club head and still avoid the heel or toe scuffing which curved sole Putters were designed to avoid. It is also the only way that the sighting system, located on the top of the club head, can be of true value since it establishes a true line of sight for the golfer when the golfer's eyes are behind the ball.

Having described a preferred embodiment of a new and improved golf putter constructed in accordance with the present invention, it is believed that other modification, variations and changes will be suggested to those skilled in the art in view of the above description. It is therefore to be understood that all such variations, modifications and changes are believed included in the scope of the invention as defined in the appended claims.

I claim:

1. A golf putter comprising a club head having heel and toe ends and front, rear, top and bottom surfaces and a shaft secured at said club head, said club head having a height dimension extending between said top and bottom surfaces, a length dimension extending between said heel and toe ends and depth dimension extending between said front and rear surfaces, said club head being shaped substantially as a solid elongate parallelepiped modified in that the top and bottom surfaces have respectively different depth dimensions as between the front and rear surfaces, and the club head comprising:

a body member formed of a first material and encompassing all said front surface, all of said top surface and minor portion of said bottom surface;

a sole plate formed of a second material secured to said body member and encompassing a major portion of said bottom surface, said sole plate including heel and toe portions disposed at said heel and toe ends, respectively, and an elongated intermediate portion connecting said heel and toe portions, said heel and toe portions having greater height dimensions and smaller length dimensions than said intermediate portion;

wherein said second material has a specific gravity at least twice that of said first material and is harder than said first material; and wherein said body member and said sole plate are each symmetrical about and imaginary vertical plane which bisects the length dimension of said club head.

2. The golf putter according to claim 1 wherein said bottom surface is flat over at least 75% of its area.

3. The golf putter according to claim 2 wherein said body member includes at least two hollow portions on respective sides of said imaginary plane.

4. The golf putter according to claim 2 further comprising sighting means disposed on said top surface of said club head, said sighting means comprising:

a recess defined in said top surface and terminating in an upwardly facing recessed surface;

first and second sighting lines located on said recessed surface, said first sighting line extending depthwise of said club head and in said imaginary vertical plane, said second sighting line extending lengthwise of said club head and intersecting said first line; and third and fourth sighting lines located on said top surface of said club head, said third sighting line extending from opposite sides of said recess depthwise of said club head and said imaginary vertical plane, said fourth sighting line extending from opposite sides of said recess lengthwise of said club head parallel to and rearwardly of said second line;

wherein said second recessed line and said fourth sighting line define a plane which is skewed to vertical.

5. The golf putter according to claim 4 wherein said sighting means further includes a fifth upper sighting line located on said top surface and extending parallel to and spaced slightly rearwardly of said fourth sighting line.

6. The golf putter according to claim 4 wherein said shaft is secured at the club head at a location which is centered between the heel and toe ends.

7. The golf putter according to claim 1 wherein the first material is aluminum and said second material is steel.

8. The golf putter according to claim 1 wherein the first and bottom surfaces of said sole plate intersect to define a first edge having a substantially straight middle segment from which respective first and second straight end segments extend to said heel and toe ends, respectively, said first and second end segments being mutually divergent heightwise of said forward surface in a direction toward the top surface:

wherein said bottom surface includes, a flat planar base portion extending lengthwise between said heel and toe ends and extending depthwise to include said intermediate segment, said base portion having a length which is greater than said intermediate segments; a first recessed portion bounded by said first end segment, said heel end, and said base portion, and a second recessed portion bounded by said second end segment, said toe end and said base portion.

9. The golf putter according to claim 8 wherein said first and second recessed portions are respective flat planar areas of said bottom surfaces which intersect at said base portion.

10. The golf putter according to claim 8 wherein said shaft is secured at the club head at a location which is centered between the heel and toe ends.

11. The golf putter according to claim 10 further comprising sighting means disposed on said top surface of said club head and centered longitudinally on said intermediate segment for facilitating alignment of a players line of sight with a position centered lengthwise of said intermediate segment.

12. The golf putter according to claim 11 wherein said sighting means comprises:

a recess defined in said top surface and terminating in an upwardly facing recessed surface;

first and second sighting lines located on said recessed surface, said first sighting line extending depthwise of said club head and in said imaginary vertical plane, said second sighting line extending lengthwise of said club head and intersecting said first line, and third and fourth sighting lines located on said top surface of said club head, said third sighting line extending from opposite sides of said recess depthwise of said club head and said imaginary vertical plane, said fourth sighting line extending from opposite sides of said recess lengthwise of said club head parallel to and rearwardly of said second line;

wherein said second line and said fourth sighting line define a plane which is skewed to vertical.

13. The golf putter according to claim 12 wherein said sighting means further includes a fifth upper sighting line located on said top surface and extending parallel to and spaced slightly rearwardly of said fourth sighting line.

14. The golf putter according to claim 1 wherein the first and bottom surfaces of said sole plate intersect to define a first edge having a substantially straight intermediate segment from which respective first and second straight end segments extend to said heel and toe ends, respectively, said first and second end segments being mutually divergent heightwise of said forward surface in a direction toward the top surface:

wherein said bottom surfaces includes, a flat planar base portion extending lengthwise between said heel and toe ends and extending depthwise to include said intermediate segment, said base portion having a length which is greater than said intermediate segments; a first recessed portion bounded by said first end segment, said heel end, and said base portion; and a second recessed portion bounded by said second end segment, said toe end and said base portion.

15. A golf putter comprising:

a shaft member;

a club head having a top surface, a front putting surface, a bottom surface, a rear surface, a heel end and a toe end opposite said heel end, said club head having a lengthwise dimension extending between said heel and toe end and a depthwise dimension extending between said front and rear surfaces;

connecting means securing said shaft member to said club head; and sighting means defined in said club head for facilitating alignment of a golfer's line of sight with a location centered lengthwise on said front surface, said sighting means comprising;

a recess defined in said top surface and terminating in an upwardly facing recessed surface;

first and second sighting lines located on said recessed surface, said first sighting line extending depthwise of said club head and in an imaginary vertical plane, said second sighting line extending lengthwise of said club head and intersecting said first sighting line; and third and fourth sighting lines located on said top surface of said club head, said third sighting line extending from opposite sides of said recess depthwise of said club head and in said imaginary vertical plane, said fourth sighting line extending from opposite sides of said recess lengthwise of said club head parallel to and rearwardly of said second line;

wherein said second line and said fourth sighting line define a plane which is skewed to vertical;

and wherein said connecting means includes a connecting member between the club head and a bottom end of the shaft member, the connecting member spacing the bottom end of the shaft member above the top surface of the club head with the shaft member axially aligned at least with the first sighting line and inclined upwardly toward the heel end of the club head, and the connecting member being bent depthwise of the club head to provide substantially unobstructed vision of the sighting means.

16. The golf putter according to claim 15 wherein said sighting means further includes a fifth upper sighting line located on said top surface and extending parallel to and spaced slightly rearwardly of said fourth sighting line.

17. The golf putter according to claim 15 wherein said connecting member is secured at the club head at a location which is centered between the heel and toe ends in alignment with the first sighting line.

18. The golf putter according to claim 17 wherein the connecting member is secured to the rear surface of the club head.

19. The golf putter according to claim 15, wherein said club head comprises;

a body member formed of a first material and encompassing all of said front surface, all of said top surface and a minor portion of said bottom surface;

a sole plate formed of a second material secured to said body member and encompassing a major portion of said bottom surface, said sole plate including heel and toe portions disposed at said heel and toe ends, respectively, and a elongated intermediate portion connecting said heel and toe portions, said heel and toe portions having a greater height dimension and smaller length dimension than said intermediate portion, wherein said second material has a specific gravity at least twice that of the first material and is harder than said first material; and wherein said body member and said sole plate are each symmetrical about an imaginary vertical plane which bisects the lengthwise dimension of said club head.

20. A golf putter comprising:

a shaft member:

a club head having a he el end, a toe end opposite said heel end, a top surface, a bottom surface, a front putting surface, and a rear surface, the club head having a peripheral configuration of a substantially solid rectangular, elongate parallelepiped modified in that a depth dimension of the top surface as between the front and rear surfaces is different from a depth dimension of the bottom surface as between the front and rear surfaces;

means securing said shaft member to the rear surface of said club head centrally between the heel and toe ends;

wherein said bottom surface includes a flat co-planer portion for stably positioning said club head on the ground during alignment of a putt;

wherein said club head is equally balanced in weight on opposite sides of an imaginary vertical plane bisecting said club head lengthwise, with most of the weight of the club head being concentrated closer to the heel and toe ends than to said plane, and closer to said bottom surface than to said top surface; and sighting means including a rectangular recess disposed in said top surface symmetrically with respect to said vertical plane for facilitating alignment of a player's line of sight in said imaginary plane from a location above and depthwise rearwardly of said club he ad, the recess including vertical recess-defining walls spaced inwardly from each of the four side surfaces of the club head, and the recess further including a flat base wall.

21. The golf putter according to claim 20 wherein said shaft member is secured to the club head by a connecting member at a location on the rear surface of the club head which is centered between the heel and toe ends, the connecting member extending over the top surface of the club head and being attached to a bottom end of the shaft member at a position spaced above the top surface of the club head.

22. The golf putter according to claim 20 wherein said club head comprises;

a body member formed of a first material and encompassing all of said front surface, all of said top surface and a minor portion of said bottom surface;

a sole plate formed of a second material secured to said body member and encompassing a major portion of said bottom surface, said sole plate including heel and toe portions disposed at said heel and toe ends, respectively, and an elongated intermediate portion connecting said heel and toe portions, said heel and toe portions having a greater height dimension and smaller length dimension than said intermediate portion;

wherein said second material has a specific gravity at least twice that of the first material and is harder than said first material; and wherein said body member and said sole plate are each symmetrical about an imaginary vertical plane which bisects the lengthwise dimension of said club head.

23. The golf putter according to claim 22 wherein the specific gravity of said second material is at least twice the specific gravity of said first material.

24. The golf putter according to claim 22 wherein the first and bottom surfaces of said sole plate intersect to define a first edge having a substantially straight middle segment from which respective first and second straight end segments extend to said heel and toe ends, respectively, said first and second end segments being mutually divergent heightwise of said forward surface in a direction toward the top surface:

wherein said bottom surfaces includes; a flat planar base portion extending lengthwise between said heel and toe ends and extending depthwise to include said intermediate segment, said base portion having a length which is greater than said intermediate segment; a first recessed portion bounded by said first end segment, said heel end, and said base portion; and a second recess portion bounded by said second end segment, said toe end and said base portion.

25. The golf putter according to claim 20 wherein said recess terminates in an upwardly facing recess surface and said sighting means comprises:

first and second sighting lines located on said recessed surface, said first sighting line extending depthwise of said club head and said imaginary vertical plane, said second sighting line extending lengthwise of said club head and intersecting said first line; and third and fourth sighting lines located on said top surface of said club head, the third sighting line extending from opposite sides of said recess depthwise of said club head and said imaginary vertical plane, said fourth sighting line extending from opposite side of said recess lengthwise of said club head parallel to and rearwardly of said second line;

wherein said second line and said fourth sighting line define a plane which is skewed to vertical.

26. The golf putter according to claim 25 wherein said sighting means further includes a fifth upper sighting line located on said top surface and extending parallel to and spaced slightly rearwardly of said fourth sighting line.

27. A golf putter comprising a shaft member, a club head having a top surface, a front putting surface, a bottom surface, a rear surface, a heel end and a toe end opposite said heel end, said club head having a lengthwise dimension extending between said heel and toe ends, and a depthwise dimension extending between said front and rear surfaces, connecting means securing the shaft member to said club head, and sighting means defined in said club head for facilitating alignment of a golfer's line of sight with a desired striking location on said front surface, wherein said sighting means includes at least a first sighting line extending depthwise of the club head in alignment with said desired striking location, and wherein the connecting means includes a connecting member between the club head and a bottom end of the shaft member, the connecting member spacing the bottom end of the shaft member above the top surface of the club head with the shaft member being centered on the sighting line and inclined upwardly toward the heel end of the club head, the connecting member being bent depthwise of the club head thereby leaving the sighting line visually unobstructed and the connecting member being secured to the rear surface of the club head in alignment with the first sighting line.

28. The golf putter according to claim 27 wherein the sighting means includes at least one further sighting line perpendicular to the first sighting line and the shaft member is axially aligned with the further sighting line.

29. The golf putter according to claim 28 wherein the putter head is formed with a recess in the top surface and the sight lines have portions extending across the recess.

30. The golf putter according to claim 28 wherein the putter head is substantially symmetrical about each of the sighting lines.

31. The golf putter according to claim 27 wherein the bottom surface of the putter head has a flat central portion.

* * * * *